US005896089A

United States Patent [19]

Bowles

[11] Patent Number: 5,896,089

[45] Date of Patent: Apr. 20, 1999

[54] DUAL CARBON MONOXIDE DETECTION SYSTEM WITH GAS CUT OFF AND ALARM CAPABILITIES

[76] Inventor: Cleveland L. Bowles, 284 Terrace Dr., Herculaneum, Mo. 63048

[21] Appl. No.: 08/920,776

[22] Filed: Aug. 29, 1997

[51] Int. Cl.[6] ..... G08B 17/10

[52] U.S. Cl. ..... 340/632; 340/693; 165/11.1; 431/16; 431/22

[58] Field of Search ..... 340/628, 632, 340/693, 577–579; 165/11.1; 431/16, 22; 73/23.31, 23.34, 31.01–31.03

[56] References Cited

U.S. PATENT DOCUMENTS

| | | | |
|---|---|---|---|
| 5,280,802 | 1/1994 | Comuzie, Jr. | 340/632 |
| 5,379,026 | 1/1995 | Whittle | 340/632 |
| 5,477,913 | 12/1995 | Polk et al. | 165/12 |
| 5,576,739 | 11/1996 | Murphy | 340/632 |
| 5,608,384 | 3/1997 | Tikijian | 340/632 |

*Primary Examiner*—Daniel J. Wu

[57] ABSTRACT

A dual carbon monoxide detection system is provided including a gas furnace having a heat exchanger with a supply air duct for delivering heated air and a return air duct for receiving air to be heated. The gas furnace further has a gas input line for receiving gas from a gas supply line for heating purposes. A first carbon monoxide detector is situated within the supply air duct for generating an activation signal upon the detection of more than a predetermined amount of carbon monoxide. Associated therewith is a second carbon monoxide detector situated within the return air duct for generating the activation signal upon the detection of more than a predetermined amount of carbon monoxide. A gas valve is coupled between the gas input line and the gas supply line. The gas valve is adapted to preclude the flow of gas through the gas input line only upon the receipt of power. Connected to the gas valve is a relay for delivering power thereto upon the receipt of the activation signal. Finally, a controller is adapted to continuously transmit the activation signal to the relay upon the receipt thereof from at least one of the carbon monoxide detectors.

5 Claims, 3 Drawing Sheets

DUAL CARBON MONOXIDE DETECTION SYSTEM WITH GAS CUT OFF AND ALARM CAPABILITIES

BACKGROUND OF THE INVENTION

1. Field of the Invention

The present invention relates to a dual carbon monoxide detection system with gas cut off and alarm capabilities and more particularly pertains to employing a pair of carbon monoxide detector units to prevent exposure to dangerous carbon monoxide gas.

2. Description of the Prior Art

The use of carbon monoxide sensors is known in the prior art. More specifically, carbon monoxide sensors heretofore devised and utilized for the purpose of detecting various levels of carbon monoxide are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,276,434; U.S. Pat. No. 3,909,816; U.S. Pat. Des. 350,300; U.S. Pat. No. 4,088,986; U.S. Pat. No. 4,778,113; and U.S. Pat. No. 4,345,242.

In this respect, the dual carbon monoxide detection system with gas cut off and alarm capabilities according to the present invention substantially departs from the conventional concepts and designs of the prior art, and in so doing provides an apparatus primarily developed for the purpose of employing a pair of carbon monoxide detector units to prevent exposure to dangerous carbon monoxide gas.

Therefore, it can be appreciated that there exists a continuing need for a new and improved dual carbon monoxide detection system with gas cut off and alarm capabilities which can be used for employing a pair of carbon monoxide detector units to prevent exposure to dangerous carbon monoxide gas. In this regard, the present invention substantially fulfills this need.

SUMMARY OF THE INVENTION

In view of the foregoing disadvantages inherent in the known types of carbon monoxide sensors now present in the prior art, the present invention provides an improved dual carbon monoxide detection system with gas cut off and alarm capabilities. As such, the general purpose of the present invention, which will be described subsequently in greater detail, is to provide a new and improved dual carbon monoxide detection system with gas cut off and alarm capabilities which has all the advantages of the prior art and none of the disadvantages.

To attain this, the present invention essentially comprises a gas furnace having a heat exchanger. Such heat exchanger is equipped with a supply air duct for delivering heated air and a return air duct for receiving air to be heated. Note FIG. 1. The gas furnace further includes a gas input line for receiving gas from a gas supply line for heating purposes. Next provided is a first carbon monoxide detection means situated within the supply air duct. During use, the first carbon monoxide detection means is adapted for generating an activation signal upon the detection of more than a predetermined amount of carbon monoxide. Associated therewith is a second carbon monoxide detection means situated within the return air duct for generating the activation signal upon the detection of more than a predetermined amount of carbon monoxide, similar to the first carbon monoxide detection means. As shown in FIGS. 3 & 4, the first and second carbon monoxide detection means resides within respective housings each with a rectilinear configuration. As shown in FIG. 3, each housing is equipped with a lip extending from a first side face thereof and further in coplanar relationship with a second side face. A pair of apertures are formed in the lip. The carbon monoxide detection means each have a cylindrical probe extending from the second side face of the corresponding housing. By this structure, the sensor is situated within a bore formed in the associated duct such that the housing is mounted to an exterior of the duct via a pair of screws situated through the apertures of the lip. Preferably, a heat resistant gasket is situated between each housing and the corresponding duct. As shown in FIG. 5, an audible alarm is provided. Such audible alarm serves to emit a high intensity noise upon the receipt of the activation signal. Also included is a gas valve coupled between the gas input line and the gas supply line. In use, the gas valve functions to preclude the flow of gas through the gas input line only upon the receipt of power. As shown in FIG. 2, the gas valve is situated within a cubical box with a first side face having a threaded aperture formed therein and a second side face opposite the first side face with a threaded tubular protrusion coupled thereto. Such protrusion is equipped with a smooth tapered end. The threaded aperture of the box is adapted to screwable engage a threaded tubular protrusion of the gas inlet line, thereby providing fluidic communication therebetween. The gas supply line has a flared end with a sleeve rotatably situated thereon. The sleeve includes a plurality of internal threads and an outboard end with a frusto-conical configuration. As such, the flared end of the gas supply line is situated over the smooth tapered end of the threaded tubular protrusion of the box and the sleeve threadedly engaged with the threaded tubular protrusion of the box. This prevents the leakage of gas flowing between the gas supply line and the gas input line. As shown in FIG. 5, a relay means is connected to the gas valve for delivering power thereto upon the receipt of the activation signal. Further included is a reset button adapted to generate a reset signal upon the depression thereof. Finally, control means is connected to the first and second carbon monoxide sensors, audible alarm, gas valve, relay means, and reset button. During use, the control means is adapted to continuously transmit the activation signal to the audible alarm and the relay means upon the receipt thereof from at least one of the carbon monoxide detection means. Furthermore, the control means is further adapted to continue to transmit the activation signal to the audible alarm and the relay means until the receipt of both the reset signal and the lack of receipt of the activation signal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dual carbon monoxide detection system with gas cut off and alarm capabilities which has all the advantages of the prior art carbon monoxide sensors and none of the disadvantages.

It is another object of the present invention to provide a new and improved dual carbon monoxide detection system with gas cut off and alarm capabilities which may be easily and efficiently manufactured and marketed.

It is a further object of the present invention to provide a new and improved dual carbon monoxide detection system with gas cut off and alarm capabilities which is of a durable and reliable construction.

An even further object of the present invention is to provide a new and improved dual carbon monoxide detection system with gas cut off and alarm capabilities which is susceptible of a low cost of manufacture with regard to both materials and labor, and which accordingly is then susceptible of low prices of sale to the consuming public, thereby making such dual carbon monoxide detection system with gas cut off and alarm capabilities economically available to the buying public.

Still yet another object of the present invention is to provide a new and improved dual carbon monoxide detection system with gas cut off and alarm capabilities which provides in the apparatuses and methods of the prior art some of the advantages thereof, while simultaneously overcoming some of the disadvantages normally associated therewith.

Still another object of the present invention is to employ a pair of carbon monoxide detector units to prevent exposure to dangerous carbon monoxide gas.

Lastly, it is an object of the present invention to provide a new and improved dual carbon monoxide detection system including a gas furnace having a heat exchanger with a supply air duct for delivering heated air and a return air duct for receiving air to be heated. The gas furnace further has a gas input line for receiving gas from a gas supply line for heating purposes. A first carbon monoxide detector is situated within the supply air duct for generating an activation signal upon the detection of more than a predetermined amount of carbon monoxide. Associated therewith is a second carbon monoxide detector situated within the return air duct for generating the activation signal upon the detection of more than a predetermined amount of carbon monoxide. A gas valve is coupled between the gas input line and the gas supply line. The gas valve is adapted to preclude the flow of gas through the gas input line only upon the receipt of power. Connected to the gas valve is a relay for delivering power thereto upon the receipt of the activation signal. Finally, a controller is adapted to continuously transmit the activation signal to the relay upon the receipt thereof from at least one of the carbon monoxide detectors.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
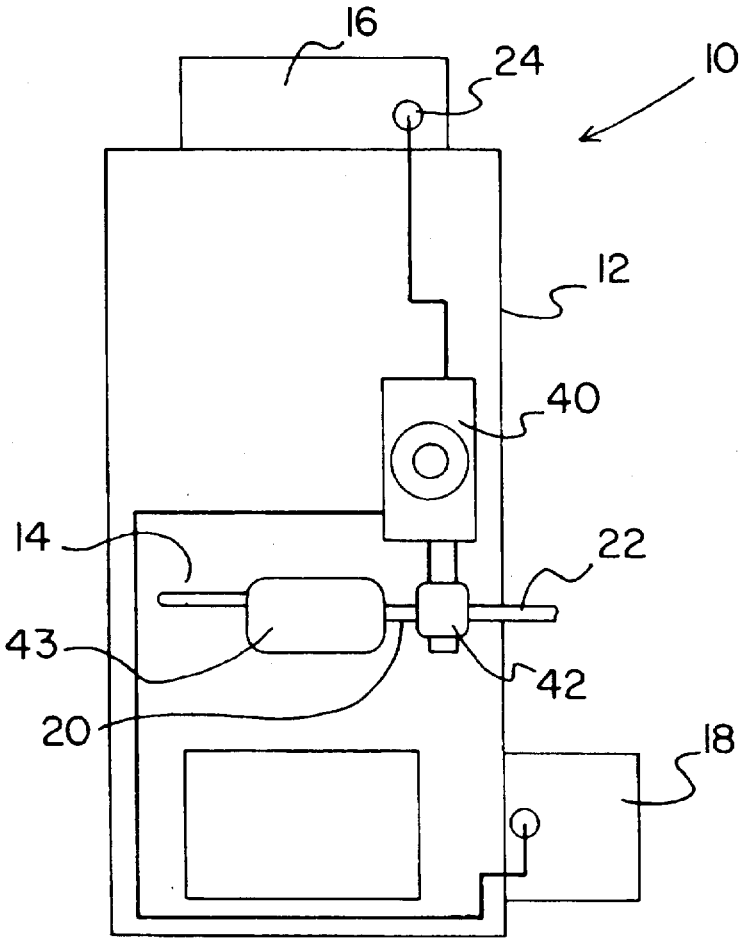
FIG. 1 is a perspective illustration of the preferred embodiment of the dual carbon monoxide detection system with gas cut off and alarm capabilities constructed in accordance with the principles of the present invention.

With reference now to the drawings, and in particular to FIG. 1 thereof, a new and improved dual carbon monoxide detection system with gas cut off and alarm capabilities embodying the principles and concepts of the present invention and generally designated by the reference numeral 10 will be described.

The present invention, the new and improved dual carbon monoxide detection system with gas cut off and alarm capabilities, is comprised of a plurality of components. Such components in their broadest context include two carbon monoxide detection means, an audible alarm, and a gas valve. Such components are individually configured and correlated with respect to each other so as to attain the desired objective.

More specifically, it will be noted that the system 10 of the present invention includes a gas furnace 12 having a heat exchanger 14. Such heat exchanger is equipped with a supply air duct 16 for delivering heated air and a return air duct 18 for receiving air to be heated. Note FIG. 1. The gas furnace further includes a gas input line 20 for receiving gas from a gas supply line 22 for heating purposes.

Next provided is a first carbon monoxide detection means 24 situated within the supply air duct. During use, the first carbon monoxide detection means is adapted for generating an activation signal upon the detection of more than a predetermined amount of carbon monoxide. The first carbon monoxide detection means is ideally positioned for sensing carbon monoxide released by rust holes due to condensation or defects in manufacturing. Associated therewith is a second carbon monoxide detection means 26 situated within the return air duct for generating the activation signal upon the detection of more than a predetermined amount of carbon monoxide, similar to the first carbon monoxide detection means. The second carbon monoxide detection means is provided specifically to sense any carbon monoxide which may be present as a result of a broken flue pipe or improper ventilation of the gas fired water heater.

Figure 3:
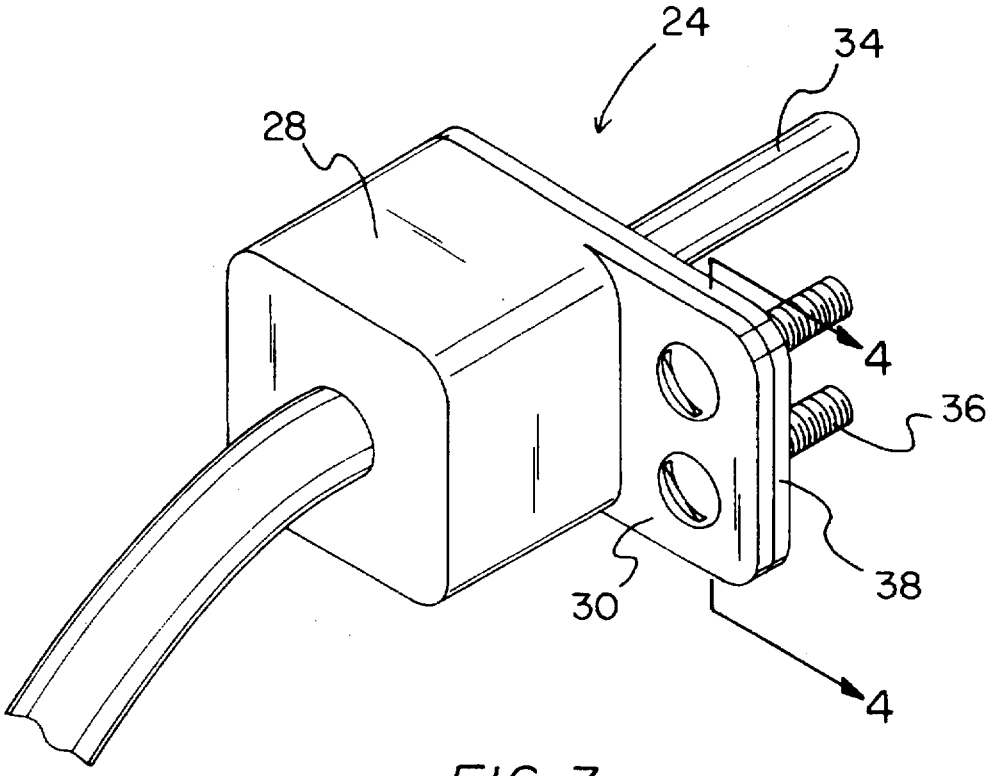
FIG. 3 is a perspective view of one of the housings of the carbon monoxide detection means.
Figure 4:
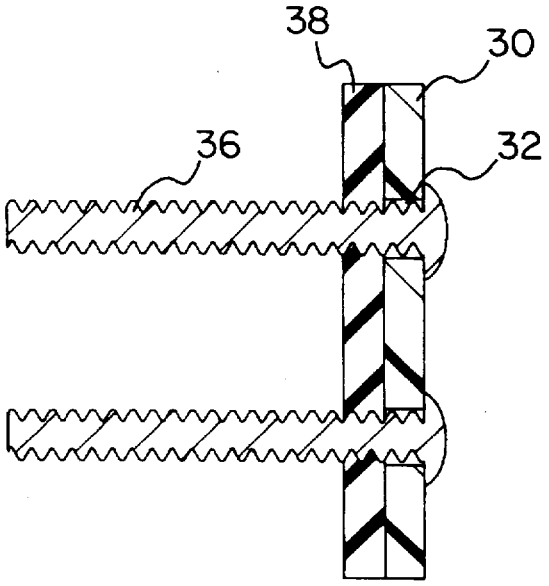
FIG. 4 is a cross-sectional view of the housing of FIG. 3 depicting the gasket.

As shown in FIGS. 3 & 4, the first and second carbon monoxide detection means reside within respective housings 28 each with a rectilinear configuration. As shown in FIG. 3, each housing is equipped with a lip 30 extending from a first side face thereof and further in coplanar relationship with a second side face. A pair of apertures 32 are formed in the lip. The carbon monoxide detection means each have a cylindrical probe 34 extending from the second side face of the corresponding housing. By this structure, the probe is situated within a bore formed in the associated duct such that the housing is mounted to an exterior of the duct via a pair of screws 36 situated through the apertures of the lip. Preferably, a heat resistant gasket 38 is situated between each housing and the corresponding duct.

Electrically, each of the carbon monoxide detection means comprises an operational amplifier 39 with a first input connected to a carbon monoxide sensor. Such sensor generates a voltage commensurate with a level of carbon monoxide detected, as is conventional. A second input of the operation amplifier is a predetermined voltage afforded by means of a voltage divider. As such, a comparator is constructed which produces the activation signal when the voltage of the sensor exceeds the voltage of the voltage divider. It should be understood that the activation signal comprises of a constant signal of a predetermined magnitude. Power is preferably provided from a DC power supply 41 which receives power from a 24V alternating power supply which may be afforded by a conventional power receptacle and a step down transformer.

Figure 5:
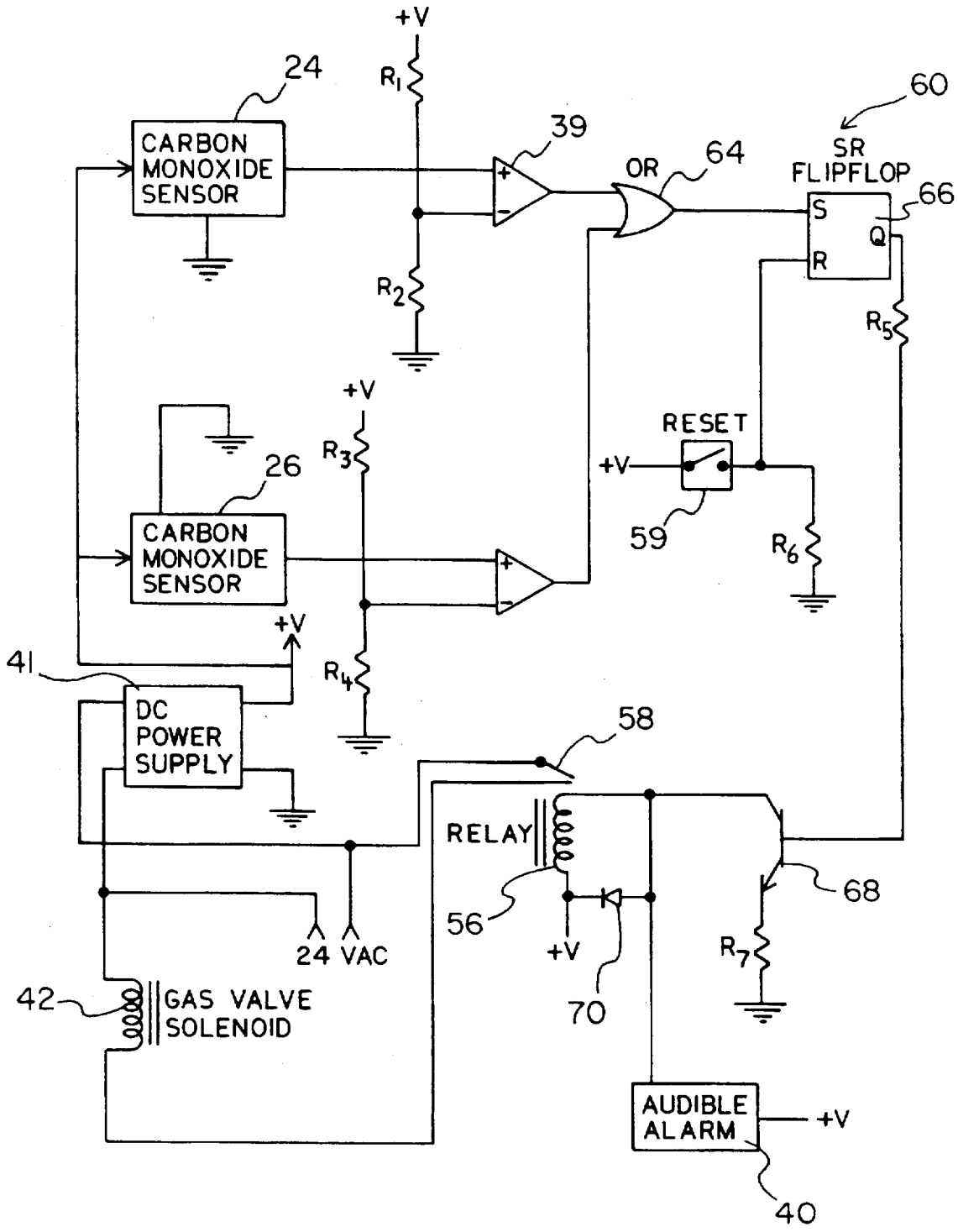
FIG. 5 is a schematic diagram of the various electrical components of the present invention.

As shown in FIG. 5, an audible alarm 40 is provided. Such audible alarm serves to emit a high intensity noise upon the receipt of the activation signal.

Also included is a gas valve 42 coupled between the gas input line and the gas supply line. In use, the gas valve functions to preclude the flow of gas through the gas input line only upon the receipt of power. Such is accomplished by way of a solenoid and transducer valve. It is imperative that the gas valve 42 be positioned upstream from the conventional gas valve controller 43 which normally controls the flow of gas during use. This is imperative so that upon the gas vale 42 cutting off gas, the pilot light will cut off since gas will not be present in the gas valve controller 43.

Figure 2:
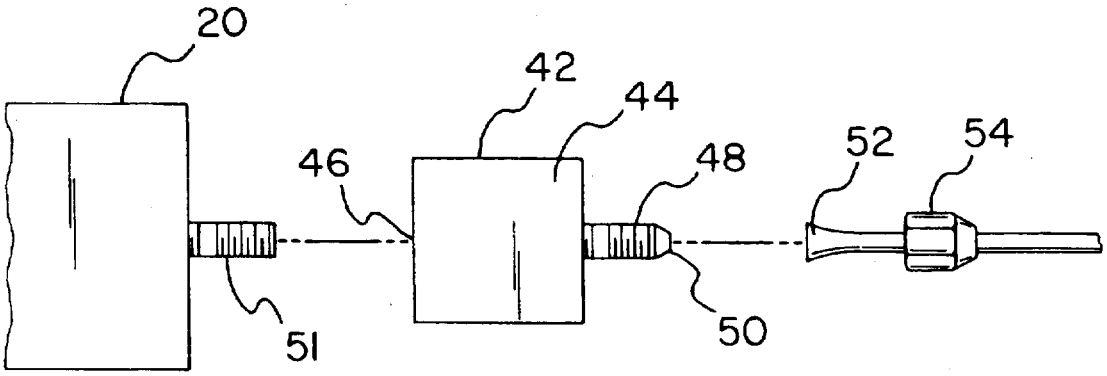
FIG. 2 is an exploded view of the gas inlet line, gas supply line, and gas valve of the present invention.

As shown in FIG. 2, the gas valve is situated within a cubical box 44 with a first side face having a threaded aperture 46 formed therein and a second side face opposite the first side face with a threaded tubular protrusion 48 coupled thereto. Such protrusion is equipped with a smooth tapered end 50. The threaded aperture of the box is adapted to screwable engage a threaded tubular protrusion 51 of the gas inlet line, thereby providing fluidic communication therebetween.

With continuing reference to FIG. 2, the gas supply line has a flared end 52 with a sleeve 54 rotatably situated thereon. The sleeve includes a plurality of internal threads and an outboard end with a frusto-conical configuration. In use, the flared end of the gas supply line is situated over the smooth tapered end of the threaded tubular protrusion of the box and the sleeve threadedly engaged with the threaded tubular protrusion of the box. This prevents the leakage of gas flowing between the gas supply line and the gas input line.

As shown in FIG. 5, a relay means 56 is connected to the gas valve for delivering power thereto upon the receipt of the activation signal. A contact 58 of the relay means is connected between the alternating current source and the gas valve for providing the power. Further included is a reset button 59 adapted to generate a reset signal upon the depression thereof.

Finally, control means 60 is connected to the first and second carbon monoxide sensor means, audible alarm, gas valve, relay means, and reset button. During use, the control means is adapted to continuously transmit the activation signal to the audible alarm and the relay means upon the receipt thereof from at least one of the carbon monoxide detection means. Furthermore, the control means is further adapted to continue to transmit the activation signal to the audible alarm and the relay means until the receipt of both the reset signal and the lack of receipt of the activation signal.

To accomplish such, the control means includes an OR gate 64 with a pair of inputs each connected to an associated one of the outputs of the operational amplifiers. Such OR gate is, in turn, connected to an S input of a SR flip flop 66. An R input of the SR flip flop is connected to the reset button. The SR flip flop further has an output connected to both the audible alarm and the relay means. In the preferred embodiment, the alarm and relay means is driven by an amplifier transistor 68 which increases the magnitude of the activation signal. A diode 70 is connected between the input of the audible alarm and the relay.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved dual carbon monoxide detection system with gas cut off and alarm capabilities comprising, in combination:

a gas furnace having a heat exchanger with a supply air duct for delivering heated air and a return air duct for receiving air to be heated, the gas furnace further having a gas input line for receiving gas from a gas supply line for heating purposes;

a first carbon monoxide detection means situated within the supply air duct for generating a first activation signal upon the detection of more than a predetermined amount of carbon monoxide;

a second carbon monoxide detection means situated within the return air duct for generating a second activation signal upon the detection of more than a predetermined amount of carbon monoxide;

said first and second carbon monoxide detection means residing within respective housings each with a rectilinear configuration, each housing having a lip extending from a first side face thereof and further in coplanar relationship with a second side face with a pair of apertures formed in the lip, the carbon monoxide detection means each having a cylindrical probe extending from the second side face of the corresponding housing, wherein the probe is situated within a bore formed in the associated duct such that the housing is mounted to an exterior of the duct via a pair of screws situated through the apertures of the lip with a heat resistant gasket situated therebetween;

an audible alarm adapted to emit a high intensity noise upon the receipt of at least one of the activation signals;

a gas valve coupled between the gas input line and the gas supply line, the gas valve adapted to preclude the flow of gas through the gas input line only upon the receipt of power;

said gas valve situated within a cubical box with a first side face having a threaded aperture formed therein and a second side face opposite the first side face with a threaded tubular protrusion coupled thereto with a smooth tapered end, the threaded aperture of the box adapted to screwable engage a threaded tubular protrusion of the gas inlet line, the gas supply line having a flared end with a sleeve rotatably situated thereon with the sleeve equipped with a plurality of internal threads and an outboard end with a frusto-conical configuration, whereby the flared end of the gas supply line is situated over the smooth tapered end of the threaded tubular protrusion of the box and the sleeve threadedly engaged with the threaded tubular protrusion of the box for preventing the leakage of gas flowing between the gas supply line and the gas input line;

relay means connected to the gas valve for delivering power thereto upon the receipt of at least one of the activation signals;

a reset button adapted to generate a reset signal upon the depression thereof; and control means connected to the first and second carbon monoxide sensors, audible alarm, gas valve, relay means, and reset button, the control means adapted to continuously transmit the activation signals to the audible alarm and the relay means upon the receipt thereof from at least one of the carbon monoxide detection means, the control means further adapted to continue to transmit the activation signals to the audible alarm and the relay means until the receipt of both the reset signal and the lack of receipt of the activation signals.

2. A dual carbon monoxide detection system with gas cut off capabilities comprising:

a gas furnace having a heat exchanger with a supply air duct for delivering heated air and a return air duct for receiving air to be heated, the gas furnace further having a gas input line for receiving gas from a gas supply line for heating purposes;

a first carbon monoxide detection means situated within the supply air duct for generating a first activation signal upon the detection of more than a predetermined amount of carbon monoxide;

a second carbon monoxide detection means situated within the return air duct for generating a second activation signal upon the detection of more than a predetermined amount of carbon monoxide;

a gas valve coupled between the gas input line and the gas supply line, the gas valve adapted to preclude the flow of gas through the gas input line only upon the receipt of power;

relay means connected to the gas valve for delivering power thereto upon the receipt of at least one of the activation signals; and control means adapted to continuously transmit the activation signals to the relay means upon the receipt thereof from at least one of the carbon monoxide detection means;

wherein the gas valve is situated within a box with a first side face having a threaded aperture formed therein and a second side face with a threaded tubular protrusion coupled thereto with a smooth tapered end, the threaded aperture of the box adapted to screwable engage a threaded tubular protrusion of the gas inlet line, the gas supply line having a flared end with a sleeve rotatable situated thereon with the sleeve equipped with a plurality of internal threads and an outboard end with a frusto-conical configuration, whereby the flared end of the gas supply line is situated over the smooth tapered end of the threaded tubular protrusion of the box and the sleeve threadedly engaged with the threaded tubular protrusion of the box for preventing the leakage of gas flowing between the gas supply line and the gas input line.

3. A dual carbon monoxide detection system with gas cut off capabilities as set forth in claim 2 wherein the first and second carbon monoxide detection means reside within respective housings each having a lip extending from a first side face thereof and further in coplanar relationship with a second side face with at least one aperture formed in the lip, the carbon monoxide detection means each having a cylindrical probe extending from the second side face of the corresponding housing, wherein the probe is situated within a bore formed in the associated duct such that the housing is mounted to an exterior of the duct via at least one screw situated through the aperture of the lip with a heat resistant gasket situated therebetween.

4. A dual carbon monoxide detection system with gas cut off capabilities as set forth in claim 2 wherein a reset button is adapted to generate a reset signal, whereby the control means is further adapted to continue to transmit the activation signals to the relay means until the receipt of both the reset signal and the lack of receipt of the activation signals.

5. A dual carbon monoxide detection system with gas cut off capabilities as set forth in claim 2 and further including an audible alarm adapted to emit a high intensity noise upon the receipt of at least one of the activation signals, whereby the control means is adapted to continuously transmit the activation signals to the audible alarm upon the receipt thereof from at least one of the carbon monoxide detection means.

* * * * *